US005632482A

United States Patent [19]

Anghelo

[11] Patent Number: 5,632,482

[45] Date of Patent: May 27, 1997

[54] VERTICALLY DISPOSED MULTI-LEVEL PINBALL GAME

[75] Inventor: Python Anghelo, Chicago, Ill.

[73] Assignee: Williams Electronics Games, Inc., Chicago, Ill.

[21] Appl. No.: 547,958

[22] Filed: Oct. 25, 1995

Related U.S. Application Data

[63] Continuation of Ser. No. 180,230, Jan. 12, 1994, abandoned.

[51] Int. Cl.[6] ..... A63F 7/36

[52] U.S. Cl. ..... 273/121 R; 273/121 A; 273/119 R; 273/118 R

[58] Field of Search ..... 273/118–125; 21/13

[56] References Cited

U.S. PATENT DOCUMENTS

| | | | |
|---|---|---|---|
| D. 352,738 | 11/1994 | Anghelo et al. | D21/13 |
| 4,375,286 | 3/1983 | Seitz et al. | 273/121 A |
| 4,606,545 | 8/1986 | Ritchie | 273/121 A |
| 4,840,375 | 6/1989 | Lawlor et al. | 273/119 A X |
| 5,284,342 | 2/1994 | Tanzer et al. | 273/121 A |
| 5,332,217 | 7/1994 | Gottlieb | 273/121 A |
| 5,335,910 | 8/1994 | Tanzer et al. | 273/121 A X |

*Primary Examiner*—Raleigh W. Chiu
*Attorney, Agent, or Firm*—Rudnick & Wolfe

[57] ABSTRACT

The invention comprises a multilevel, vertically oriented pinball game arranged in a cabinet that occupies a minimum of floor space. Because the smaller game cabinet limits the depth of the playfield, a single horizontal playfield would not provide the play or challenge of a standard game. To overcome this drawback, the pinball game of the invention includes a plurality of vertically displaced playfields. The playfields are arranged such that the player plays vertically between the playfields as well as playing horizontally on the individual playfields. Each playfield includes a number of play features such that even though the game is contained in a smaller cabinet it will provide a typical number of play features. At least one player controlled flipper is provided on each playfield to allow the player to control the ball when on that level. A wide variety of ramps or other ball transfer devices can be used to convey the ball between the playfields.

12 Claims, 3 Drawing Sheets

VERTICALLY DISPOSED MULTI-LEVEL PINBALL GAME

This is a continuation of application Ser. No. 08/180,230 filed on Jan. 12, 1994, now abandoned.

BACKGROUND OF THE INVENTION

The invention relates, generally, to pinball games and, more particularly, to a vertically disposed, multi-level pinball game housed in a video game cabinet.

The typical pinball game consists of an inclined playfield supporting a plurality of play features such as targets, ramps, bumpers, skill shots and the like, a rolling ball and player operated flippers. The player operates the flippers to direct the ball at selected play features thereby to score points and control play of the game.

A typical pinball game is shown in U.S. Pat. No. 4,375,286 where the playfield is horizontally disposed and supported in a pinball game cabinet including a back box which houses the electronics for controlling the game and the visual displays for scores and animations. The typical pinball game cabinet is approximately 54 inches long and 30 inches wide. Moreover, the play area, i.e. the area below the glass cover and above the playfield on which the pinballs roll, is approximately 48 inches long, 20 inches wide and between 3 and 8 inches high.

As will be appreciated, the standard pinball game is played substantially horizontally. The ball is propelled by the flippers from the front to the back of the playfield and returns to the front by gravity. While the ball contacts and is diverted by various play features such that its path of travel is somewhat random, the play of the game occurs generally horizontally. Because of this, a relatively long, i.e. 48 inch, playfield is required to accommodate the play features and provide interesting and challenging play.

It is known in the pinball art to provide an additional, smaller playfield located either above or below the main playfield. An example of such a game is shown in U.S. Pat. No. 4,606,545 issued to Ritchie. These additional playfields are provided as secondary play areas where the player was temporarily allowed to play under certain circumstances; however, these games use the standard playfield and cabinet where play of the game is substantially horizontal.

Also known in the amusement game art are video games that typically consist of an upright cabinet housing a video monitor on which a game is played. Player operated controls are located on the front of the video cabinet to control the video images and play of the game.

A typical video game cabinet is approximately 75 inches high, 27 inches wide but only 44 inches deep. Because video game cabinets occupy much less floor space than typical pinball game cabinets, video games can be located in confined areas where pinball games cannot. For example, video games are commonly found in convenience stores, restaurants, airports and the like which do not have sufficient floor space to accommodate a standard pinball game.

Thus, a pinball game that occupies the relatively small floor space of a video game yet retains the playability, challenge and feel of the standard pinball game is desired. Moreover, a pinball game that combines substantially horizontal play of a standard pinball game with vertical play to create a more complex and challenging pinball game is desired.

SUMMARY OF THE INVENTION

The invention comprises a multi-level pinball game arranged in a video game type cabinet that occupies less floor space than the conventional pinball game. Because the smaller game cabinet limits the length of the playfield, substantially horizontal play would not provide the playability or challenge of a conventional game because flow patterns of the ball, the spacing of the play features, the number of play features and the other design considerations would be limited. To overcome these problems, the pinball game of the invention includes a plurality of playfields, each vertically displaced from the other such that the game is played in three dimensions. The playfields are arranged such that the ball moves vertically between the playfields as well as generally horizontally on the individual playfields. Each playfield includes one or more play features such that even though the game is contained in a smaller cabinet it will provide virtually the same number of play features as a standard pinball game. Moreover, at least one player controlled flipper is provided on each playfield to allow the player to control the game. A wide variety of ramps or other ball transfer devices can be used to convey the ball between the playfield.

DETAILED DESCRIPTION OF THE INVENTION

Figure 1:
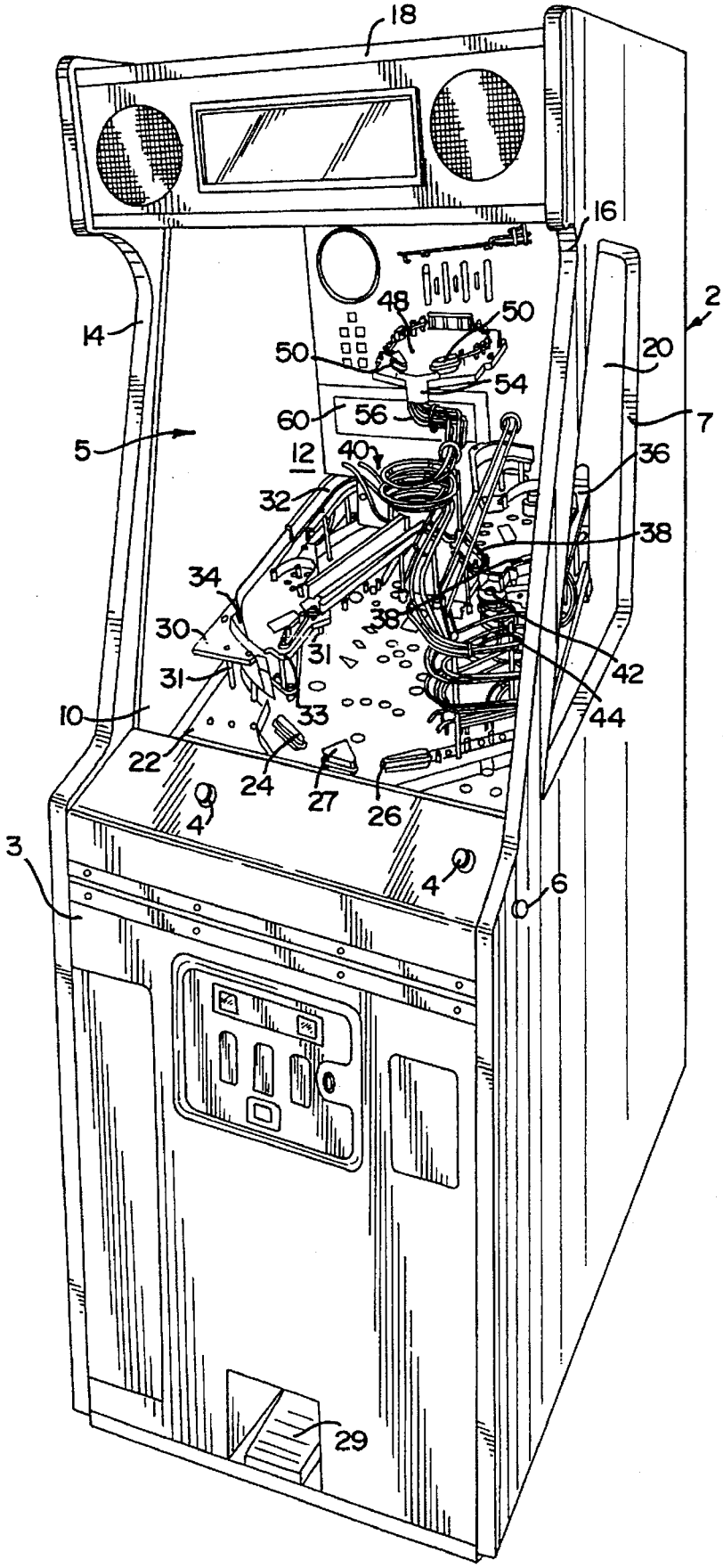
FIG. 1 is a perspective view of the pinball game of the invention.

Referring more particularly to the figures, the pinball game of the invention includes a cabinet 2 that is preferably a modified video game cabinet. The cabinet is approximately 27 inches wide, 75 inches tall and only 44 inches deep. While in the preferred embodiment it is contemplated that a standard video game cabinet is converted for use as the pinball game cabinet 2, it will be appreciated that the salient feature of the cabinet is that it is significantly less deep than a standard pinball game cabinet yet provides sufficient vertical space for the game. As will be apparent, a cabinet could be built specifically for the pinball game of the invention that differs from the illustrated cabinet provided that it can house the vertically disposed pinball game of the invention as hereinafter described. A side window 7 can be provided to allow observation of play of the game, however, window 7 is optional.

The lower portion 3 of the cabinet 2, located beneath the play area 5, contains the electronics for controlling the game. Player operated buttons 4 are located on the front of cabinet 1 to operate player controlled features such as skill shots and the like as necessitated by the specific game design. Buttons 4 can be eliminated if such player controlled skill shots are not included in the game or where the flipper buttons 6, provided one on each side of cabinet 1, perform the dual function of controlling the game's flippers and any player controlled skill shots.

In the play area 5 (where the video display of a video game would normally be located), a transparent, substantially vertical transparent glass cover 10 is provided that allows a view of internal space 12. Space 12 is defined by the sidewalls 14 and 16; the top 18 of cabinet 2; the back wall 20; the main playfield 22 and cover glass 10. As will be apparent, the internal space 12 of the pinball game of the invention provides significantly more vertical space than a typical pinball game. As a result, the pinball game of the invention is played in three dimensions as opposed to the standard game that is played in substantially two dimensions on an elongated horizontal playfield.

The internal space 12 contains, a plurality of elevated playfields in addition to the main playfield 22, each playfield being disposed at a different level within the internal space. It will be appreciated that the number of playfields and their location within the space can be varied as desired by a game designer. Moreover, each playfield can support a number of play features such as targets, bumpers, roll over switches, lights and the like. Finally, it is contemplated that each playfield will be provided with at least one player controlled flipper (or other device) to propel the ball on that playfield and control play of the game.

In the illustrated embodiment, the main playfield 22 extends the entire width and depth of the cabinet such that it defines the lower surface of space 12 as previously described. Playfield 22 is arranged similarly to the traditional playfield where a pair of flippers 24 and 26 are arranged at the front end of the playfield with a drain hole (not shown) located substantially between and behind the flippers. Playfield 22 is further provided with a plurality of targets, bumpers and other scoring opportunities as will be appreciated by one skilled in the art. One such play feature is a ball kicker 27 as described in copending U.S. patent application Ser. No. 08/135,069 filed Oct. 12, 1993, entitled "Flipper Kicker". As disclosed in that application, ball kicker 27 can be controlled by a foot operated pedal 29 if desired. Foot pedal 29 can control other devices or the ball kicker 27 can be controlled by button 4.

A second, smaller playfield 30 is supported on back wall 20 and pins 31 in an elevated position relative to the main playfield. A ramp 32 is provided to deliver the ball from the main playfield 22 to the second playfield 30 such that the ball can move from the main playfield to the second playfield. The ramp 32 can also allow the ball to return to the main playfield from second playfield 30. Moreover, a ball drop 33 allows the ball to exit playfield 30 and drop onto main playfield 22. Like the main playfield 22, the second playfield 30 will also be provided with a plurality of targets, bumpers and other play features, and a player controlled flipper 34. The targets and bumpers are arranged on playfield 30 to prevent the ball from exiting the playfield except via the desired ramps.

In a preferred embodiment, a third playfield 36 is provided that is supported on back wall 20 in an elevated position relative to second playfield 30. Like playfield 30, the third playfield 36 supports a plurality of play features and at least one (preferably two) pair of player operated flippers 38. Any suitable mechanism 40 can be used to deliver the ball from the first playfield to the second playfield. One such mechanism is disclosed in copending U.S. patent application Ser. No. 08/164,058 entitled "Serpentine Ramp For a Pinball Game".

The third playfield 36 includes a drain hole 42 located behind flippers 38. Drain hole 42 communicates with a device 44 for lowering the ball from the third playfield 36 to the main playfield 22. One such ball lowering device is shown in copending U.S. patent application Ser. No. 08/134,984 filed Oct. 12, 1993, entitled "Helical Monorail Ramp". Of course, other ball lowering devices can be used as desired.

A ball transfer device 46, such as the device disclosed in copending U.S. patent application Ser. No. 08/141,256 filed Oct. 22, 1993, entitled "Player Controlled Dump Ramp", is provided to move the ball from the third playfield 36 to a fourth playfield 48 supported on the back wall 20. The fourth playfield 48 is located so as to be positioned above the second and third playfields. A ball drain 54 located between and behind the flippers 50 communicates with a wire form or plastic ramp 56 or the like for delivering the ball from the fourth playfield 48 to the main playfield 22.

Video display 60 is provided on back wall 20 for displaying scores, balls and other game information. Additionally, video display 60 can permit video game play or other animations as disclosed in U.S. Pat. No. 4,375,286 issued to Seitz et al.

Figure 2:
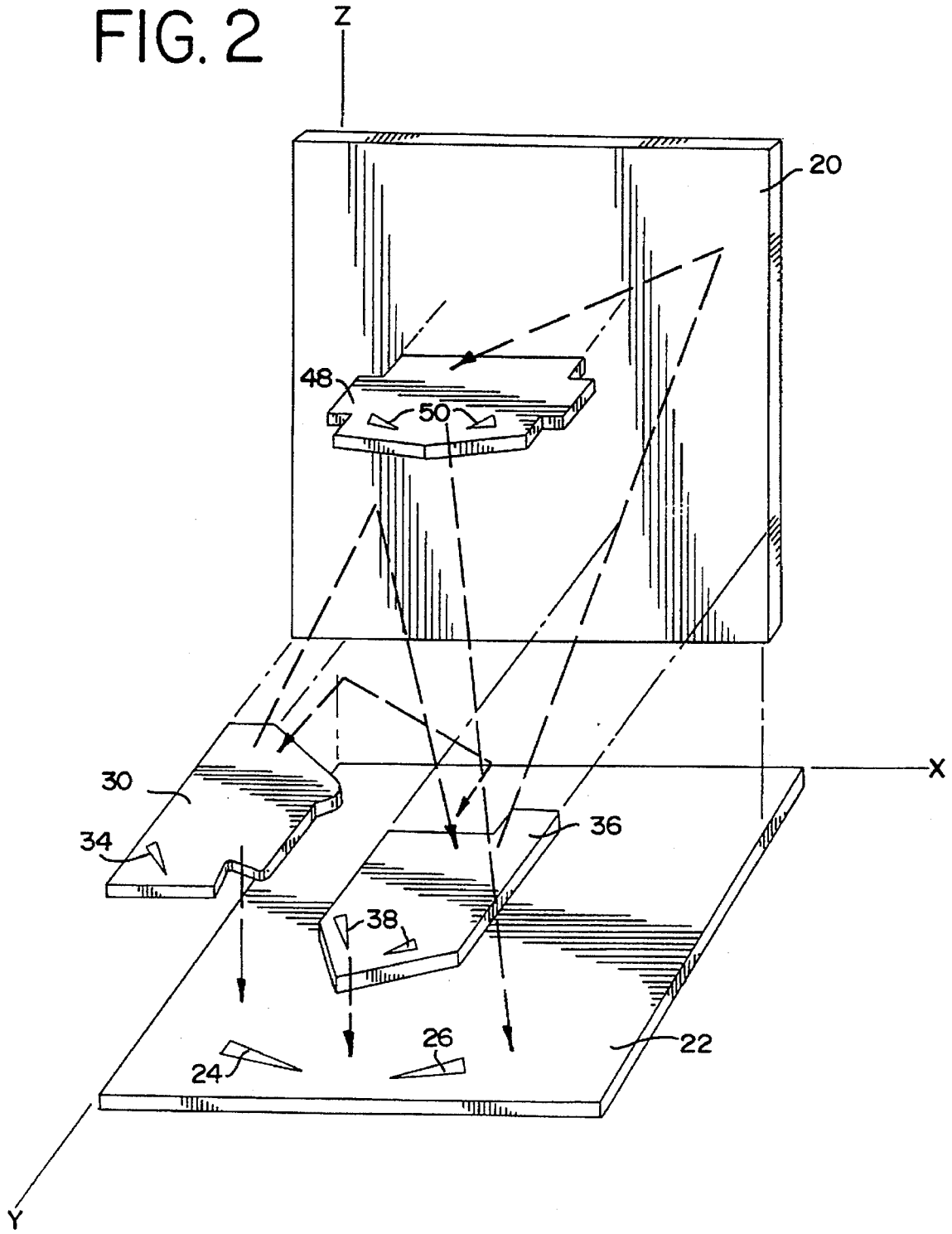
FIG. 2 is a schematic exploded view showing the spatial arrangement of the playfields of the invention.
Figure 3:
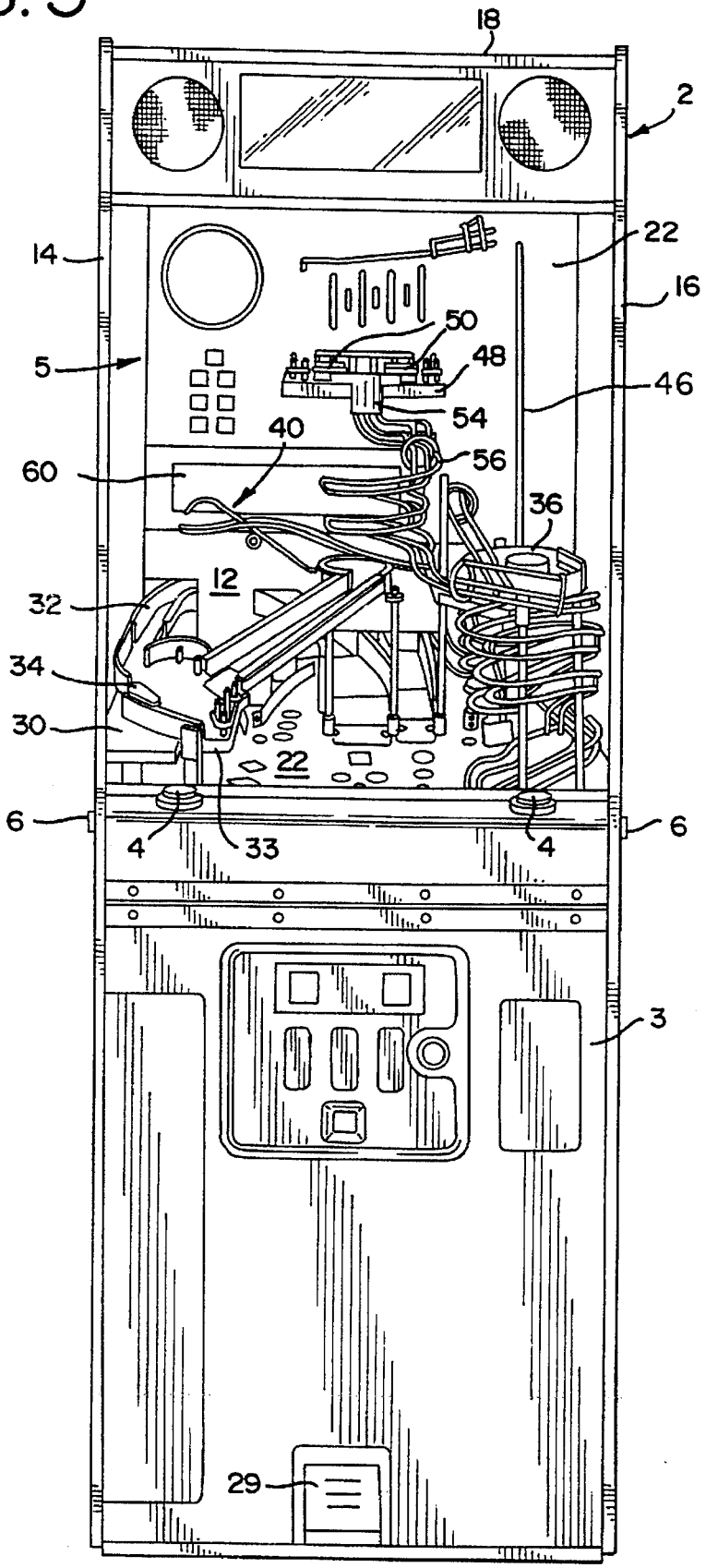
FIG. 3 is a front view of the pinball game of the invention.

FIG. 2 shows an exploded, simplified schematic view of the vertical arrangement of the playfields in the pinball game of the invention. The arrows of FIG. 2 generally illustrate the movement of the ball as it travels between the playfields. Between the substantially vertical movement of the ball between playfields and the substantially horizontal movement of the ball on the individual playfields, the pinball game of the invention is played in three dimensions with substantial play along the X, Y and Z axes. In the preferred embodiment, the ball is conveyed upwardly from each playfield to the next higher playfield such that play of the game proceeds in a step manner. Additionally, each of the playfields includes a ramp or other mechanism for delivering the ball from each of the elevated playfields back to the main playfield. As a result, play of the illustrated game is designed to require the player to climb the playfields sequentially. It is further contemplated that the scoring values as the player climbs the game will increase to encourage vertical play. It will be appreciated that patterns of ball movement between the playfields other than that illustrated can be used if desired. For example, means can be provided to deliver the ball from the main playfield directly to any of the additional playfields.

As will be appreciated, each playfield can be provided with any number of play features and the mechanisms for conveying the ball between the playfields can be of any suitable design. By providing a relatively short main playfield and a plurality of other playfields disposed vertically above the main playfield at different elevations, the game includes a vertical component of play not found in the standard horizontal pinball games such that the game retains the playability, complexity and challenge of a typical game yet takes less floor space than the standard pinball game.

While the invention has been described in some detail with reference to the figures, it will be appreciated that numerous changes in the details and construction of the device can be made without departing from the spirit and scope of the invention.

What is claimed is:

1. A vertically-oriented multi-level pinball game comprising:

a) an upright cabinet defining an interior space and having a transparent front wall;

b) a main playfield extending a length disposed within said cabinet, for supporting a rolling ball thereon, the main playfield and cabinet defining a play space having a vertical height which is at least equal to the length of the playfield;

c) play features disposed both on the playfield and at various locations above the playfield within said play space;

d) means for conveying the ball between the main playfield and the play features disposed thereabove to permit game play in three dimensions.

2. The pinball game of claim 1, wherein the front wall comprises an upright cover glass for viewing the play space from a horizontal direction.

3. The pin, ball game of claim 1, wherein each of the side walls comprises a window which permits viewing of the play space from a horizontal direction.

4. The pinball game of claim 1, wherein some of said play features are provided on a plurality of additional playfields mounted in said play space above said main playfield.

5. A vertically-oriented pinball game comprising:

a) an upright cabinet for housing a number of play features and including a back wall, two side walls, a top wall and a transparent front wall;

b) a main playfield for supporting a rolling ball thereon and extending substantially from the front wall to the back wall to define a main playfield length, the main playfield and cabinet defining a play space having a height that is at least equal to the main playfield length;

c) a plurality of play features are disposed within said play space such that the ball rolls to play features which are substantially above said main playfield to permit the game to be played in three dimensions.

6. The pinball game of claim 5, wherein the cabinet comprises an upright cover glass for viewing the play space from a horizontal direction.

7. The pinball game of claim 6, wherein the cabinet comprises side windows which permit viewing of the play space from a horizontal direction.

8. The pinball game of claim 5, wherein some of said play features are provided on a plurality of additional playfields mounted in said play space above said main playfield.

9. A vertically-oriented multi-level pinball game comprising:

a) an upright cabinet defining an interior space and having a transparent front wall;

b) a main playfield disposed within said cabinet for supporting a rolling ball thereon, the main playfield and cabinet defining a play space having a vertical height which is at least equal to the length of the playfield and housing therein a plurality of secondary playfields mounted in said play space;

c) means for conveying the ball between the main playfield and the play features disposed in the play space in the secondary playfields to permit game play in three dimensions.

10. The pinball game of claim 9, wherein the cabinet comprises an upright cover glass for viewing the play space from a horizontal direction.

11. The pinball game of claim 10, wherein the cabinet comprises side windows which permit viewing of the play space from a horizontal direction.

12. The pinball game of claim 9, wherein play features are provided on said secondary playfields.

* * * * *